US006030297A

United States Patent [19]

Kliewer

[11] Patent Number: 6,030,297

[45] Date of Patent: Feb. 29, 2000

[54] GOLF RANGE INDICATOR SYSTEM

[76] Inventor: Alan R. Kliewer, 2860 Windflower Place, Coquitlam, BC, Canada, V3E 2V3

[21] Appl. No.: 09/121,338

[22] Filed: Jul. 23, 1998

[51] Int. Cl.[7] ..... A63B 53/00

[52] U.S. Cl. ..... 473/407

[58] Field of Search ..... 473/407, 300, 473/201, 206, 219, 223, 231, 334, 345; 434/252, 195, 208

[56] References Cited

U.S. PATENT DOCUMENTS 641,739 1/1900 Thompson ..... 434/191
4,655,451 4/1987 Townsley ..... 473/407
5,058,891 10/1991 Takeuchi ..... 473/201
5,582,554 12/1996 Stryczek ..... 473/407
5,795,245 8/1998 Chang et al. ..... 473/334

*Primary Examiner*—Steven Wong

[57] ABSTRACT

A golf club range indicator system for indicating the distance a particular user can hit a golf ball with a particular club. The system includes a plurality of end caps each adapted for attachment to a terminal end of the shaft of a particular golf club adjacent the handgrip of the golf club. Indicia is provided on each end cap for indicating a range of distance the particular user can hit a golf ball with the particular golf club. The indicia indicates the closest distance and the furthest distance the particular user can hit the golf ball with the golf club.

9 Claims, 2 Drawing Sheets

GOLF RANGE INDICATOR SYSTEM

BACKGROUND OF THE INVENTION

1. Field of the Invention

The present invention relates to golf club range indicators and more particularly pertains to a new golf club range indicator system for indicating the distance a particular user can hit a golf ball with a particular club.

2. Description of the Prior Art

The use of golf club range indicators is known in the prior art. More specifically, golf club range indicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf club range indicators include U.S. Pat. No. 3,409,987; U.S. Pat. No. 3,824,698; U.S. Pat. No. 3,907,288; U.S. Pat. No. 4,991,338; U.S. Pat. No. 3,918,718; and U.S. Pat. No. Des. 350,178.

While these devices fulfill their respective, particular objectives and requirements, the aforementioned patents do not disclose a new golf club range indicator system. The inventive device includes a plurality of end caps each adapted for attachment to a terminal end of the shaft of a particular golf club adjacent the handgrip of the golf club. Indicia is provided on each end cap for indicating a range of distance the particular user can hit a golf ball with the particular golf club. The indicia indicates the closest distance and the furthest distance the particular user can hit the golf ball with the golf club.

In these respects, the golf club range indicator system according to the present invention substantially departs from the conventional concepts and designs of the prior art, and in so doing provides an apparatus primarily developed for the purpose of indicating the distance a particular user can hit a golf ball with a particular club.

SUMMARY OF THE INVENTION

In view of the foregoing disadvantages inherent in the known types of golf club range indicators now present in the prior art, the present invention provides a new golf club range indicator system construction wherein the same can be utilized for indicating the distance a particular user can hit a golf ball with a particular club.

The general purpose of the present invention, which will be described subsequently in greater detail, is to provide a new golf club range indicator system apparatus and method which has many of the advantages of the golf club range indicators mentioned heretofore and many novel features that result in a new golf club range indicator system which is not anticipated, rendered obvious, suggested, or even implied by any of the prior art golf club range indicators, either alone or in any combination thereof.

To attain this, the present invention generally comprises a plurality of end caps each adapted for attachment to a terminal end of the shaft of a particular golf club adjacent the handgrip of the golf club. Indicia is provided on each end cap for indicating a range of distance the particular user can hit a golf ball with the particular golf club. The indicia indicates the closest distance and the furthest distance the particular user can hit the golf ball with the golf club.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club range indicator system apparatus and method which has many of the advantages of the golf club range indicators mentioned heretofore and many novel features that result in a new golf club range indicator system which is not anticipated, rendered obvious, suggested, or even implied by any of the prior art golf club range indicators, either alone or in any combination thereof.

It is another object of the present invention to provide a new golf club range indicator system which may be easily and efficiently manufactured and marketed.

It is a further object of the present invention to provide a new golf club range indicator system which is of a durable and reliable construction.

An even further object of the present invention is to provide a new golf club range indicator system which is susceptible of a low cost of manufacture with regard to both materials and labor, and which accordingly is then susceptible of low prices of sale to the consuming public, thereby making such golf club range indicator system economically available to the buying public.

Still yet another object of the present invention is to provide a new golf club range indicator system which provides in the apparatuses and methods of the prior art some of the advantages thereof, while simultaneously overcoming some of the disadvantages normally associated therewith.

Still another object of the present invention is to provide a new golf club range indicator system for indicating the distance a particular user can hit a golf ball with a particular club.

Yet another object of the present invention is to provide a new golf club range indicator system which includes a plurality of end caps each adapted for attachment to a terminal end of the shaft of a particular golf club adjacent the handgrip of the golf club. Indicia is provided on each end cap for indicating a range of distance the particular user can hit a golf ball with the particular golf club. The indicia indicates the closest distance and the furthest distance the particular user can hit the golf ball with the golf club.

Still yet another object of the present invention is to provide a new golf club range indicator system that lets a user quickly and easily estimate how far a golf ball will travel when the user uses a particular golf club to hit the golf ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
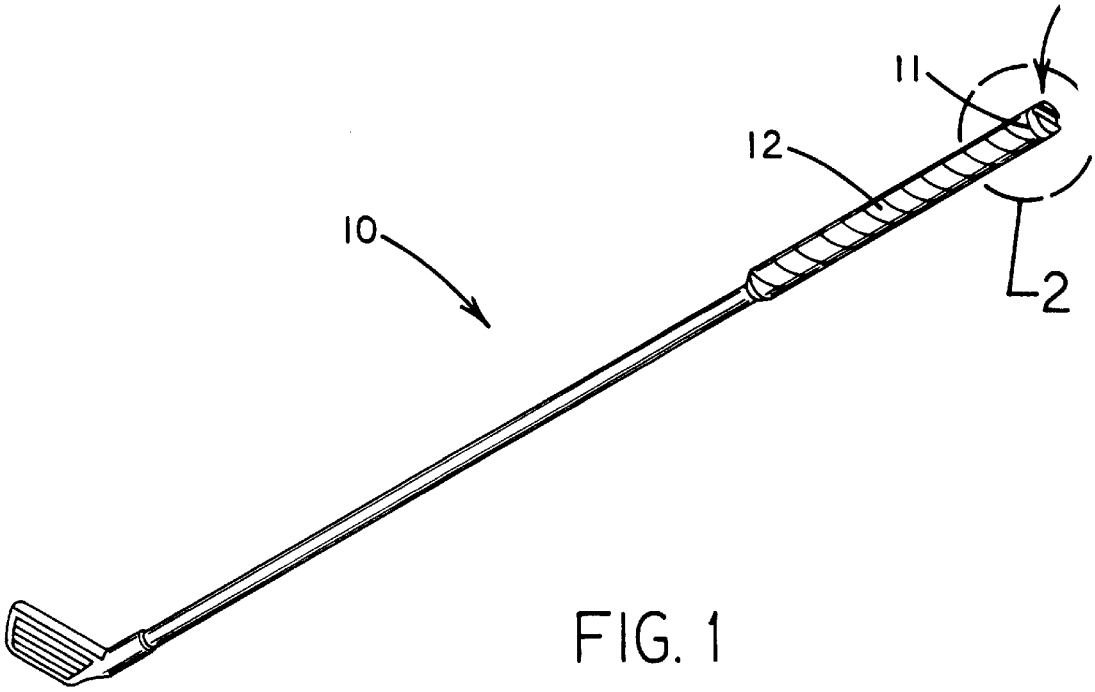
FIG. 1 is a schematic side view of an end cap of a new golf club range indicator system on a golf club according to the present invention.
Figure 2:
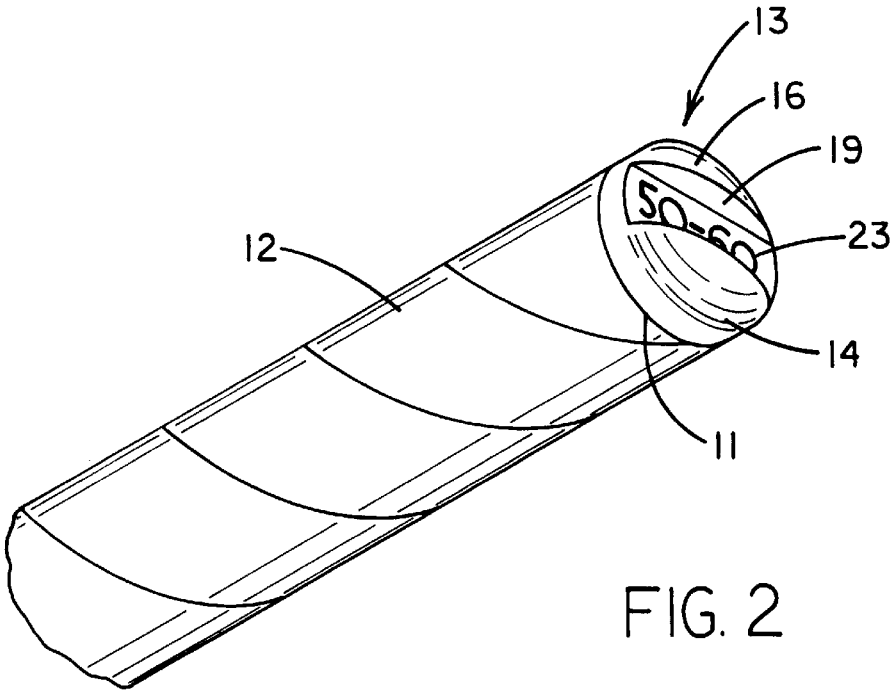
FIG. 2 is a schematic partial perspective view of the present invention taken from the circle 2 on FIG. 1.
Figure 3:
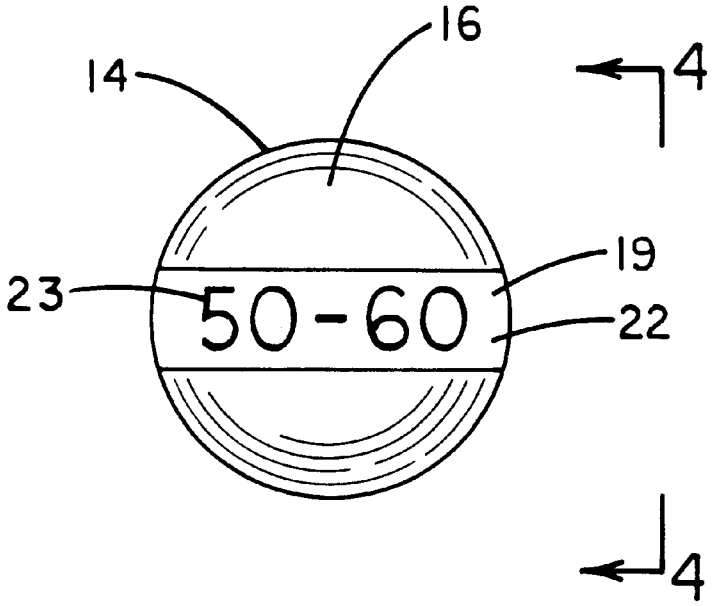
FIG. 3 is a schematic front side view of the head of the present invention.
Figure 4:
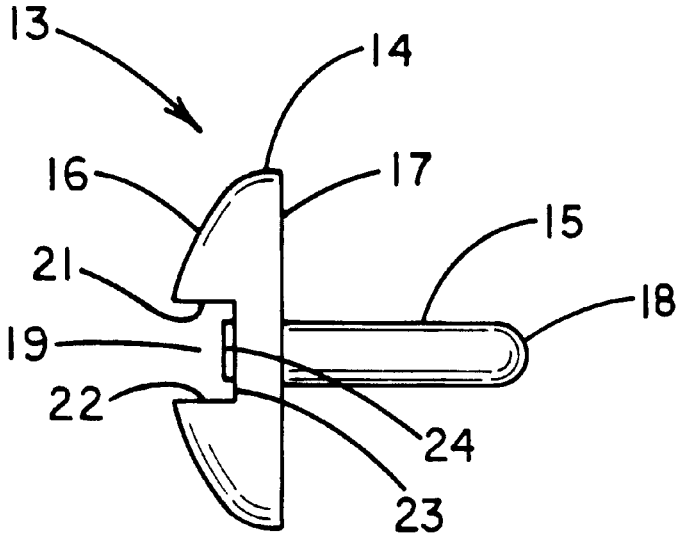
FIG. 4 is a schematic side view of the present invention.

With reference now to the drawings, and in particular to FIGS. 1 through 4 thereof, a new golf club range indicator system embodying the principles and concepts of the present invention will be described.

As best illustrated in FIGS. 1 through 4, the golf club range indicator system is designed for indicating the distance a user can hit a golf ball with a particular golf club and basically comprises indicia provided on each golf club indicating a range of distance the particular user can hit a golf ball with the golf club. The indicia should indicate the closest distance and the furthest distance the particular user can hit the golf ball with the golf club. Preferably, the system generally comprises a plurality of end caps 13 each adapted for attachment to a terminal end 11 of the shaft of a particular golf club 10 adjacent the handgrip 12 of the golf club 10 with indicia 23 provided on each end cap 13 for indicating a range of distance the particular user can hit a golf ball with the particular golf club 10.

In closer detail, the each end cap 13 comprises a head 14 and an elongate insertion pin 15. The head 14 of the end cap 13 has an outer periphery, and front and back faces 16,17. The outer periphery of the head 14 is preferably generally circular so that the head 14 has a center and a diameter. In this preferred embodiment, it is even more preferably that the front face 16 of the head 14 is generally dome-shaped and the back face 17 of the head 14 is generally planar.

The insertion pin 15 of the end cap 13 outwardly extends from the back face 17 of the head 14. The insertion pin 15 is adapted for insertion in the terminal end 11 of the shaft of the golf club 10 adjacent the handgrip 12 of the golf club 10 to attach the end cap 13 to the golf club 10. The insertion pin 15 has a longitudinal axis which preferably extends generally perpendicular to the plane of the back face 17 of the head 14. The insertion pin 15 also preferably has a generally circular cross section taken generally perpendicular to the longitudinal axis of the insertion pin 15. The tip 18 of the insertion pin 15 is also preferably rounded. The length of the insertion pin is defined between the tip 18 of the insertion pin 15 and the back face 17 of the head 14.

The front face 16 of the head 14 has an elongate recessed channel 19 which is preferably centrally positioned on the head 14 such that the length of the recessed channel 19 extends across the diameter of the head 14. The recessed channel 19 is preferably generally U-shaped and has a pair of spaced apart side walls 20,21 and a bottom wall 22 connecting the side walls 20,21 of the recessed channel 19 together. The side walls 20,21 and the bottom wall 22 of the recessed channel 19 each are generally rectangular with the side walls 20,21 of the recessed channel 19 generally parallel to one another and generally perpendicular to the bottom wall 22 of the recessed channel 19. The depth of the recessed channel 19 is defined between the front face 16 of the head 14 and the bottom wall 22 of the recessed channel 19.

Indicia 23 are provided on the bottom wall 22 of the recessed channel 19 for indicating a range of distance a particular user can hit a golf ball with the particular golf club 10. The indicia 23 indicate the closest distance and the furthest distance the particular user can hit the golf ball with the golf club 10. Each indicium has a height measured between the top and bottom of the indicium between the side walls 20,21 of the recessed channel 19. Ideally, the indicia 23 are provided on raised surfaces 24 extending from the bottom wall 22 of the recessed channel 19. Preferably, the raised surfaces 24 are shaped to conform to the shape of the indicia 23.

In an ideal illustrative embodiment, the diameter of the head 14 is greater than the length of the insertion pin 15. Ideally, the diameter of the head 14 is about ⅞ inches and the length of the insertion pin 15 is about ¾ inch (or a similar ratio therebetween). The head 14 has a thickness defined between the front and back faces 16,17 along a line extending coaxial from the center of the head 14. In this ideal illustrative embodiment, the thickness of the head 14 is about twice the depth of the recessed channel 19. Ideally, the thickness of the head 14 is about ½ inch. Preferably, the raised surface 24 rise less than ½ the depth of the recessed channel 19 from the bottom wall 22 of the recessed channel 19. Ideally, the recessed channel 19 has a width defined between the side walls 20,21 of the recessed channel 19 between about one-third and about five-sixths the width of the recessed channel 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for indicating the distance a user can hit a golf ball with a particular golf club, comprising:

a plurality of end caps, each end cap being adapted for attachment to a terminal end of the shaft of a particular golf club adjacent the handgrip of the golf club;

indicia being provided on each end cap for indicating a range of distance a particular user can hit a golf ball with the particular golf club; and said indicia indicating the closest distance and the furthest distance the particular user can hit the golf ball with the golf club; and wherein each said end cap comprises a head and an elongate insertion pin, said head of said end cap having an outer periphery, and front and back faces, said insertion pin of said end cap being outwardly extended from said back face of said head, said insertion pin being adapted for insertion in the terminal end of the shaft of the golf club adjacent the handgrip of the golf club to attach said end cap to the golf club, said front face of said head having an elongate recessed channel, and said indicia being provided on said recessed channel.

2. The system of claim 1, wherein said head of said end cap has an outer periphery, said outer periphery of said head being generally circular such that said head has a center and a diameter, said recessed channel having a length extending across said diameter of said head.

3. The system of claim 1, wherein said front face of said head is generally dome-shaped, said back face of said head being generally planar.

4. The system of claim 3, wherein said insertion pin has a longitudinal axis extending generally perpendicular to the plane of said back face of said head.

5. The system of claim 4, wherein said insertion pin has a generally circular cross section taken generally perpendicular to said longitudinal axis of said insertion pin.

6. The system of claim 1, wherein said recessed channel is generally U-shaped and has a pair of spaced apart side walls and a bottom wall connecting said side walls of said recessed channel together, and wherein said indicia are provided on said bottom wall of said recessed channel.

7. The system of claim 6, wherein said side walls and said bottom wall of said recessed channel each are generally rectangular, said side walls of said recessed channel being generally parallel to one another and generally perpendicular to said bottom wall of said recessed channel.

8. The system of claim 7, wherein said indicia are provided on raised surfaces extending from said bottom wall of said recessed channel, said raised surfaces being shaped to conform to the shape of the indicia.

9. A system for indicating the distance a user can hit a golf ball with a particular golf club, comprising:

a plurality of end caps, each end cap being adapted for attachment to a terminal end of the shaft of a particular golf club adjacent the handgrip of the golf club;

wherein said end cap comprises:

a head and an elongate insertion pin;

said head of said end cap having an outer periphery, and front and back faces;

said outer periphery of said head being generally circular, said head having a center and a diameter;

said front face of said head being generally dome-shaped, said back face of said head being generally planar;

said insertion pin of said end cap being outwardly extended from said back face of said head, said insertion pin being adapted for insertion in the terminal end of the shaft of the golf club adjacent the handgrip of the golf club to attach said end cap to the golf club;

said insertion pin having a longitudinal axis extending generally perpendicular to the plane of said back face of said head;

said insertion pin having a generally circular cross section taken generally perpendicular to said longitudinal axis of said insertion pin;

said insertion pin having a tip, said tip of said insertion pin being rounded;

said insertion pin having a length defined between said tip of said insertion pin and said back face of said head;

said front face of said head having an elongate recessed channel, said recessed channel having a length extending across said diameter of said head;

said recessed channel being generally U-shaped and having a pair of spaced apart side walls and a bottom wall connecting said side walls of said recessed channel together;

said side walls and said bottom wall of said recessed channel each being generally rectangular, said side walls of said recessed channel being generally parallel to one another and generally perpendicular to said bottom wall of said recessed channel;

said recessed channel having a depth defined between said front face of said head and said bottom wall of said recessed channel;

indicia being provided on said bottom wall of said recessed channel for indicating a range of distance a particular user can hit a golf ball with the particular golf club;

said indicia indicating the closest distance and the furthest distance the particular user can hit the golf ball with the golf club;

each indicium having a height measured between the top and bottom of the indicium between said side walls of said recessed channel;

wherein said indicia are provided on raised surfaces extending from said bottom wall of said recessed channel, said raised surfaces being shaped to conform to the shape of the indicia;

wherein said diameter of said head is greater than said length of said insertion pin;

said head has a thickness defined between said front and back faces along a line extending coaxial from said center of said head, wherein said thickness of said head is about twice said depth of said recessed channel; and wherein said recessed channel has a width defined between said side walls of said recessed channel, wherein said height of each indicium is between about one-third and about five-sixths said width of said recessed channel.

* * * * *